US005142742A

United States Patent [19]

Erni et al.

[11] Patent Number: 5,142,742

[45] Date of Patent: Sep. 1, 1992

[54] MAIN CYLINDER CASING SEGMENT

[75] Inventors: Daniel Erni, Frauenfeld; Paul Staheli, wilen bei Wil, both of Switzerland

[73] Assignee: Maschinenfabrik Rieter AG, Winterthur, Switzerland

[21] Appl. No.: 621,841

[22] Filed: Dec. 4, 1990

[30] Foreign Application Priority Data

Dec. 4, 1989 [CH] Switzerland ..... 04349/89

[51] Int. Cl.[5] ..... D01G 15/08; D01G 15/24; D01G 15/32

[52] U.S. Cl. ..... 19/113; 19/102; 19/104; 19/107

[58] Field of Search ..... 19/83, 102–104, 19/107, 110–114

[56] References Cited

U.S. PATENT DOCUMENTS

| | | | |
|---|---|---|---|
| 405,625 | 6/1889 | Tweedale | 19/102 |
| 564,125 | 7/1896 | Tweedale et al. | 19/103 |
| 3,402,432 | 9/1968 | Kalawaites | 19/113 X |
| 4,001,917 | 1/1977 | Taylor | 19/104 |
| 4,286,357 | 9/1981 | Harrison | 19/104 X |
| 4,309,796 | 1/1982 | Garrison et al. | 19/107 X |
| 4,314,387 | 2/1982 | Löffler | 19/107 X |
| 4,593,437 | 6/1986 | Graf et al. | 19/113 |
| 4,738,005 | 4/1988 | Fahmueller | 19/103 |
| 4,797,980 | 1/1989 | Jagst | 19/107 |
| 4,831,691 | 5/1989 | Hollingsworth et al. | 19/107 X |
| 5,031,278 | 7/1991 | Demuth et al. | 19/98 |

FOREIGN PATENT DOCUMENTS

| | | | |
|---|---|---|---|
| 0094781 | 11/1983 | European Pat. Off. | 19/113 |
| 0152053 | 10/1985 | European Pat. Off. . | |
| 0388791 | 9/1990 | European Pat. Off. . | |
| 409319 | 2/1925 | Fed. Rep. of Germany . | |
| 1118662 | 11/1961 | Fed. Rep. of Germany . | |
| 3336323 | 5/1985 | Fed. Rep. of Germany | 19/107 |
| 0336221 | 10/1989 | Fed. Rep. of Germany . | |
| 3835776 | 4/1990 | Fed. Rep. of Germany . | |
| 2300827 | 9/1976 | France . | |
| 662804 | 10/1987 | Switzerland . | |
| 0951220 | 3/1964 | United Kingdom | 19/103 |
| 2083848 | 3/1982 | United Kingdom | 19/107 |
| 2100305 | 12/1982 | United Kingdom | 19/114 |

OTHER PUBLICATIONS

European Search Report.

*Primary Examiner*—Werner H. Schroeder
*Assistant Examiner*—Ismael Izaguirre
*Attorney, Agent, or Firm*—Sandler, Greenblum & Bernstein

[57] ABSTRACT

A main cylinder casing segment for use with a revolving flat on a card, each of the segments including opposite end portions, adapted for fastening on a frame of the card, and a longitudinal body between the end portions for covering the main cylinder. The body includes two plate-shaped parts, a first of the parts has a surface adapted to be inwardly directed toward a working area of the card, during operation of the card, and a second of the parts constituting a stiffener for the segment. Further, the first part of the second part are connected for transferring bending stresses between the parts. The segment is thus formed as a hollow body, preferably extruded.

28 Claims, 5 Drawing Sheets

MAIN CYLINDER CASING SEGMENT

CROSS-REFERENCE TO RELATED APPLICATIONS

This application is related to commonly assigned U.S. patent application Ser. No. 07/622,619, entitled "Cooling System for a Carding Machine", filed on Dec. 5, 1990, and claims the priority of Swiss Application No. 04/349/89-9 filed Dec. 4, 1989, which is incorporated herein by reference.

BACKGROUND OF THE INVENTION

1. Field of the Invention

The present invention relates to a main cylinder casing segment for a revolving flat card.

2. Description of the Related Art

It is presently customary to provide a revolving flat with stationary carding elements in the so-called pre-carding, re-carding and under.-carding zones. The terms pre-carding, re-carding and under-carding zones are defined in commonly assigned German Patent Application No. 3,835,776. These elements are normally provided as single rods which can be grouped at all events in assembly units through fastening plates, as described in commonly assigned European Patent Application No. 336,221.

The provision of a flat-like frame for single carding elements is also known, however. Reference can be made to Swiss Patent Application PS 662,804 and FIG. 6 thereof, in particular. The idea is, however, not dealt with completely, in that

- the single elements must apparently be set up individually against the card;
- the form of the segment is not optimal from the viewpoint of savings in weight; and
- the segment is devised as a single part, without considering the function in one system.

SUMMARY OF THE INVENTION

The present invention provides for a main cylinder casing segment for a revolving flat. The segment has end parts, which are formed for the fastening to the frame of the card and a longitudinal body between the end parts for covering the main cylinder. The body contains two plate formed parts, of which one part, in the working area of the card, is provided a surface directed inward when in operation. The other part serves as a stiffener. The two parts are connected with each other in such a way that the bending stresses (shearing stresses) are transferable from one part to the other.

The segment can be formed as a hollow body. Preferably, several longitudinal conduits extend from one end to the other end of the segment.

At least one longitudinal side of the segment can be provided with a sealing element.

Through this design, the segment can be specially formed with thin walls, which makes an important savings in weight possible. The segment can be formed from two to ten fiber processing elements. With three elements, two longitudinal conduits are provided, whereby fastening means for the three elements can then be provided in the side walls of the conduits.

Every segment, whether for fiber guiding or for the fitting of fiber processing elements, can extend over a predetermined angular distance, so that segments of different types can be exchanged in their positions around the main cylinder (see German Patent Application No. 3,835,776).

The segment can be produced as an extruded profile, preferably from light metal. For certain applications, such a profile can be produced with such high precision so that no surface finishing operation to the surface is necessary.

The end parts of the segment can be formed to operate in conjunction with a means of adjustment fixed to the frame, so that the adjustment of the fiber guiding elements or the fiber processing elements results through the adjustment of the segment in relation to the main cylinder. This can, for instance, result through a swivelling movement of the segment on a predetermined axis. The end parts can then be provided with a means for the establishment of this adjustment axis.

It can be that a suspension is provided for every segment with a built-in means of adjustment. For instance, where the adjustment of the segment is to result through the swivelling movement mentioned above, the suspension contains a means which, with normal manual operation, effects the swivelling movement on the axis mentioned. A suspension of this type preferably contains two means of adjustment, each of which works in conjunction with one end part and each of which is arranged between its appropriate end part and the frame of the card.

The segment must be connected with its suspension on the adjustment axis and a second connection is necessary with the suspension in order to carry out the swivelling movement. This second connection can have an eccentric, so that the adjustment results from turning the eccentric. At least one locking element can naturally be provided in order to lock a once determined adjustment.

The segments according to the invention are especially suitable for application in a dirt separating device of a type according to U.S. Pat. No. 5,031,278, that is in a device for the separation of dirt from a fiber fleece on a rotating toothed roller, by means of which a stationary, but adjustable separating blade, arranged in opposition to the rotary movement of the toothed roller, and a preparation element, positioned to the separating blade, likewise supported and stationary, seen in the direction of rotation of the toothed roller which is likewise adjustable in the radial direction of the toothed roller, whereby an elimination gap remains open between the preparation element and the separating blade. A main cylinder casing segment according to this invention can support the preparation element and a second segment according to the invention can support the separating blade.

The preparation element can have a structured surface lying against the periphery of the toothed roller, as disclosed in Swiss Patent Application Application 4103/88.

The separating gap is preferably covered by a suction conduit. A conduit of this type can be fastened to one or both of the segments.

In view of the foregoing discussion, an object of the present invention is to provide a main cylinder casing segment for use with a revolving flat card, each of the segments including:

opposite end portions, adapted for fastening on a frame of the card, and a longitudinal body between the end portions: for covering the main cylinder;

the body including two plate-shaped parts, a first of the two plate-shaped parts having a surface adapted to be inwardly directed toward a working area of the card during operation of the card, a second of the two plate-shaped parts including a stiffener for the segment; and means for connecting the first plate-shaped part with the second plate-shaped part and for transferring bending stresses between the parts.

In one significant aspect of the invention, the segment is shaped as a hollow body between the first and second plate-shaped parts. More specifically in this regard, the hollow body includes a plurality of longitudinal conduits extending between the end portions.

According to another feature of the invention, at least one longitudinal side is provided with a sealing element.

Further, the segment includes means for receiving a plurality of fiber processing elements.

In another particular aspect of the invention, the means for receiving a plurality of fiber processing elements is adapted to receive three fiber processing elements, the plurality of longitudinal conduits consisting of two longitudinal conduits, the segment further including means for fastening at least one of the fiber processing elements on the first plate-shaped part in a side wall of one of the two longitudinal conduits.

It is a further object of the invention to form the segment by extruding same. Specifically, the segment can be made from a light metal.

A still further object of the invention is to provide means, associated with the end parts, for adjusting the position of the plurality of fiber processing elements with respect to the main cylinder. In a specific form, the adjusting means include means for radially displacing one of the end parts and for swivelling the segment on a predetermined adjustment axis located at another of the end parts. Further, the end parts including means for determining the adjustment axis.

According to a still further aspect of the invention, means are provided for suspending the segment with respect to the main cylinder, the adjusting means being built-into the suspending means. Further, the means for suspending includes means for manually effecting the swivelling.

In a further significant object of the invention, a plurality of segments are to be positioned around a working area of the main cylinder, each the casing segment including a casing segment, each the casing segment further being adapted to be interchangeable with others of the casing segments around the working area of the main cylinder.

Further, a fiber guiding segment can be interchangeable with a fiber processing segment.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
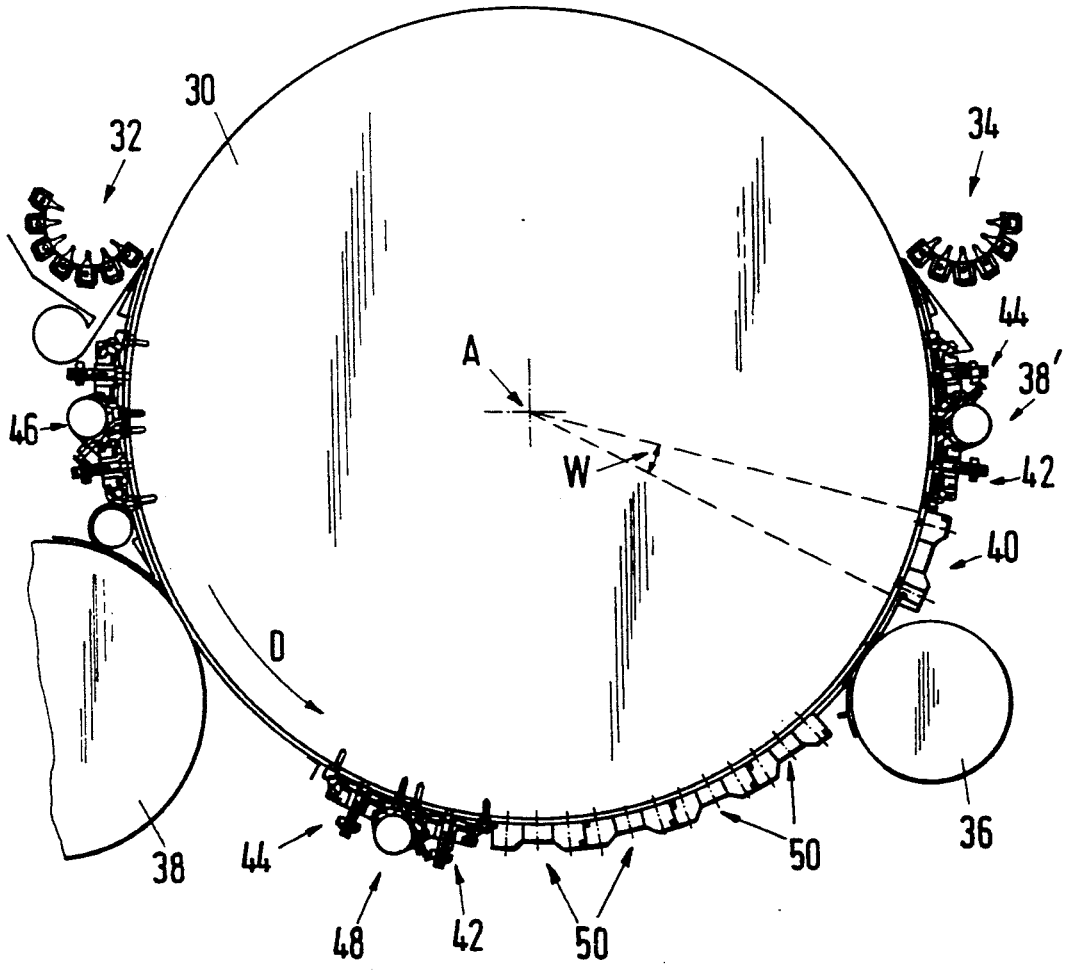
FIG. 1 is a schematic side view of a card with main cylinder casing elements according to this invention.

FIG. 1 shows in a schematic side view the main cylinder 30 of a card, the end parts 32, 34 of a revolving flat arrangement, which define the limits of the main carding zone, a licker-in 36 and a doffer 38. The direction of rotation of the main cylinder on its axis A is indicated with the arrow D.

In the pre-carding zone (between the licker-in 36 and the delivery end 34 of the revolving flat arrangement) there is a waste separation device 38' and a preceding main cylinder casing segment 40 of this device. Device 38' comprises two main cylinder casing segments 42, 44, which are described below.

The re-carding zone (between the input end 32 of the revolving flat and the doffer 38) is provided with a further waste separation device 46, which is interchangeable with device 38' and is, therefore, not described separately.

In the undercarding zone (between the doffer 38 and the licker-in 36), there is another waste separation device 48 and four main cylinder casing segments 50. Device 48 is interchangeable with devices 38' and 46 and the segments 50 are interchangeable with segment 40.

Figure 2:
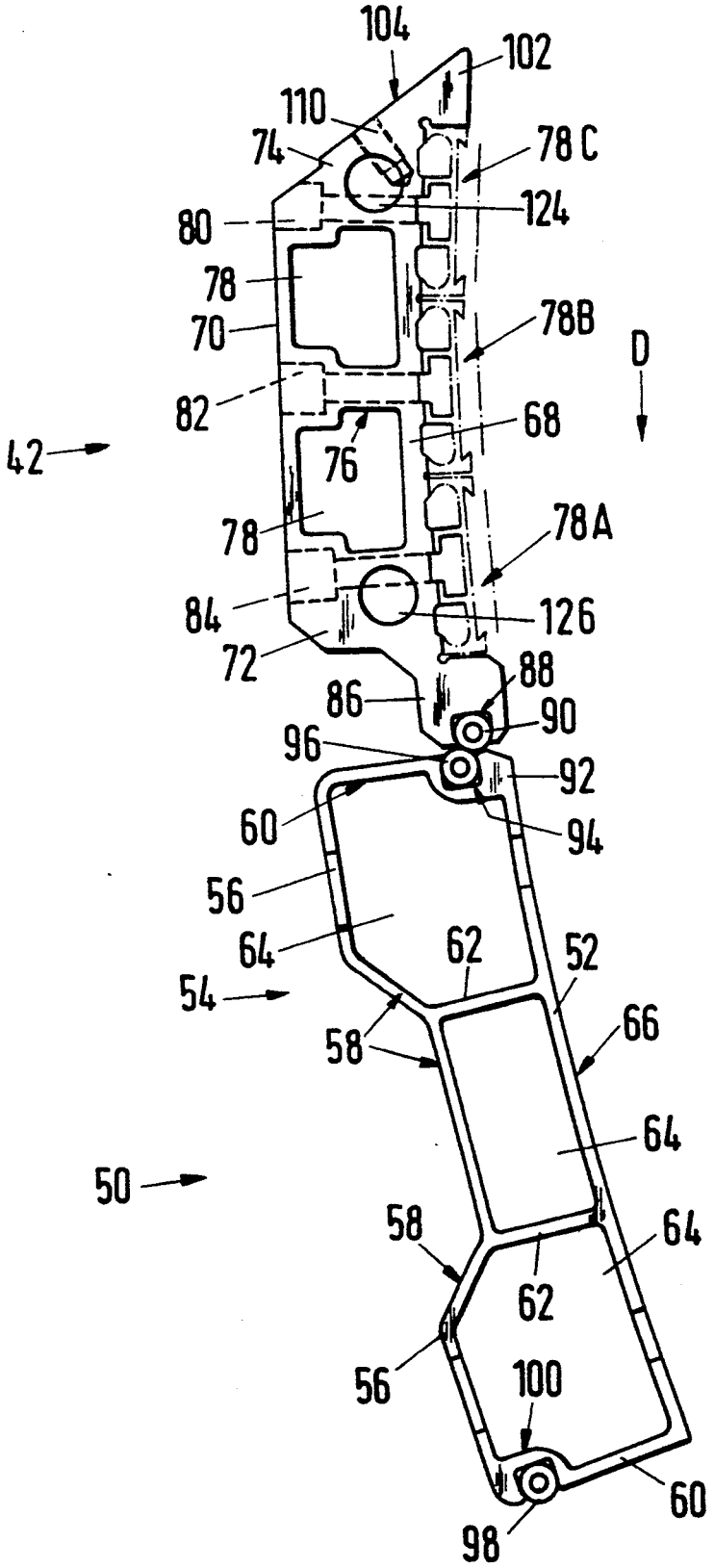
FIG. 2 is a side view of two different main cylinder casing segments according to the invention.

FIG. 2 shows two casing segments 50, 42 on an increased scale. The simpler segment 50 comprises a first plate shaped part 52 and a second plate shaped part 54, which contain two level lateral sections 56 and a curved central section 58. The plate shaped parts 52, 54 are connected with each other by side walls 60 and intermediate walls 62, thereby forming three longitudinal conduits 64. Segment 50 extends with a constant cross section over the whole width (axial length) of main cylinder 30 and is fastened to the lateral support plate of the card frame by suitable fastening means as will be described in greater detail below. Segment 50 is produced as an extruded light metal profile (e.g., aluminum). The form of the segment allows a very thin walled design which nevertheless provides the required rigidity for the segment over the whole working width. The wall thickness of segment 50 can lie in a range, for example, from 2 mm to 8 mm.

The rigidity of the segment is important, in order to maximize stability for an adjustment made to the fiber guide or fiber guiding surface 66, against the clothing drawn on to the main cylinder over the whole working width of the card frame. The fiber guide surface 66 forms an outer jacket of the working area of the card, over an angular range W corresponding to segment 50, as shown in FIG. 1 for identical segment 40 of the pre-carding zone. The angular range of this type is defined in German Patent Application 3,835,776. The rigidity provided by second plate shaped part 54 and first plate shaped part 52 enables close tolerances of the adjustment to be maintained in spite of the thin walled design. Additionally, the invention realizes weight and material savings.

The more complicated segment 42 comprises an inner plate shaped part 68 and an outer plate shaped part 70. These parts are connected with each other by a side wall 72, a side wall 74 and an intermediate wall 76 to form two longitudinal conduits 78. Segment 42 is also produced as an extruded profile from light metal. This design provides the advantage as noted above, of low weight with high rigidity. It is also contemplated that a single conduit could be provided, in which case the intermediate wall would be omitted.

Segment 42 serves not only directly as a fiber influencing element, but also as a carrier for the actual working or fiber processing elements, which are to be fixed on part 68. Such fiber processing elements are well known in the art and are not described in detail for this reason. These elements comprise, for instance, three elements, 78A, 78B and 78C, indicated by dashed lines in FIG. 2, which are fastened on part 68 by screws which are not shown. The fastening screws (not shown) for the upper element extend through a row of holes 80, shown in dashed lines in FIG. 2, in side wall 74. Similarly, there is a row of holes 82 in the intermediate wall 76 for receiving the fixing screws for the middle element 78B. Side wall 72 is also provided with a row of holes 84 for receiving fastening screws for the lower element 78C. The three elements can be provided with a fiber processing clothing, as described, for instance, in Swiss Patent Application No. 662,804. This clothing can, for instance, be a needle clothing, a saw tooth clothing or merely a structured surface according to commonly assigned U.S. Pat. No. 5,031,278.

The contact surfaces for the three elements on part 68 are determined according to the curvature of the main cylinder which, with optimal adjustment of the segment, extend over the width of every rod vertically to the respective radius of the main cylinder.

The side wall 72 is provided with an extension 86, which has a longitudinal groove 88 in the surface opening toward segment 50. This groove 88 contains an elastomeric sealing element 90, such as a hollow body.

The segments 50, 42 or 40, 42 are fitted next to each other on the card in such a manner that sealing element 90 is in contact with a lip 92 on segments 50, 40. Segments 50, 40 also have a longitudinal groove 94 adjacent to lip 92, provided with another sealing element 96, which is in contact with sealing element 90 of segment 42. Leakage currents between segments 50, 40, and 42 can be largely prevented, providing better control of the air supply over the whole width of the card. Additionally, soiling of the surrounding area of the main cylinder is also avoided.

Where two segments 50 are in a row, next to each other, for example, in the intermediate carding zone, gaps between the segments are also sealed. For this purpose, the sealing elements 96, already described, serve this purpose, with the addition of a further sealing element 98 in a groove 100, which opens in the opposite direction of groove 94.

Figure 3:
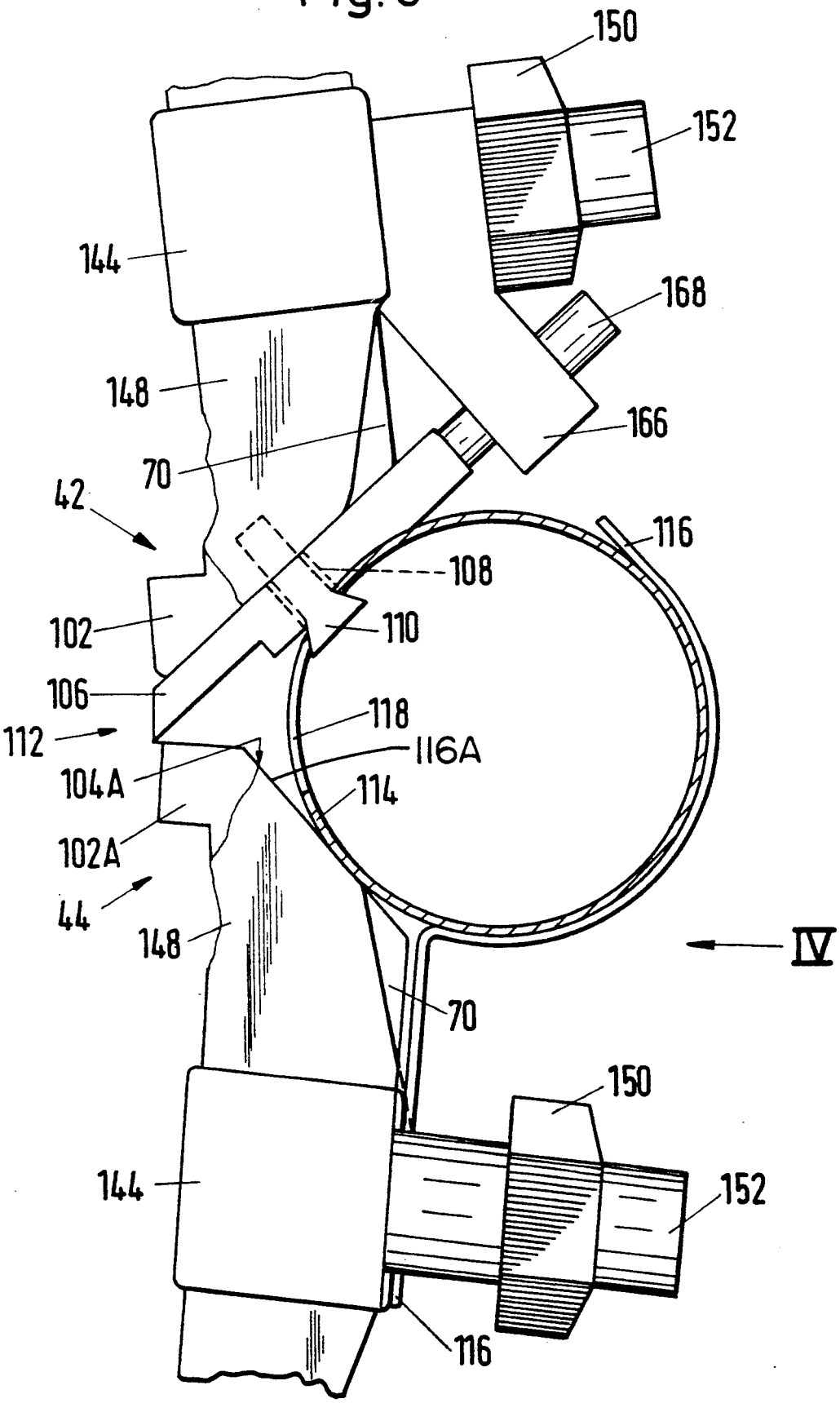
FIG. 3 is a schematic side view of a separation device with two main cylinder segments according to this invention.

Wall 74 is also provided with an extension 102 with a surface 104, which is inclined to the radial plane of main cylinder 30. This surface 104 can also be a contact surface for a waste separation blade 106 as shown in FIG. 3. Blade 106 has a through hole 108 and a screw 110 which extends through hole 108 into a screw thread 110' as shown in FIG. 2 in surface 104 of the segment, in order to fasten the blade on the extension.

FIG. 3 shows part of a waste separating blade device which, for example, can work according to U.S. Pat. No. 5,031,278. This device is comprised of two segments. One segment 42 has been described above and the second segment 44 is similar in construction to the first segment 42, but is arranged in the reverse direction against the card, such that surface 104 of segment 42 is arranged oppositely to corresponding surface 104A of segment 44. Segment 44 has a shortened extension 102A and the two segments 42, 44 are arranged next to each other in such a manner that a gap 112 remains open between the two extensions 102, 102A. Gap 112 serves as an entry opening for a suction conduit 114, which is held in contact, through a spring loaded holding element 116, with surface 116A of segment 44 and with blade 106. Holding element 116 is fastened on segment 44 by suitable means which is not shown.

Suction conduit 114 is in the form of a pipe, which stretches over the whole working width of the card and is provided with an opening 118 arranged opposite to gap 12. The method of working of this waste separation device is generally known and is not described in more detail here, as the present invention is not directed to the principle of a waste separation process but, rather, is related to the design of the waste separation device.

The suspension of the different elements on the frame of the card will now be described with reference to FIGS. 4 and 5. The fastening of segments 40, 50 on the frame can be effected without difficulty by fixing screws (not shown) and holes in the end parts of the segments. Precision manufacturing of the segment and the resulting rigidity make complicated means of adjustment unnecessary. A special suspension with means of adjustment has been designed for segments 42, 44, which will now be described referring to FIGS. 4 and 5.

Figure 4:
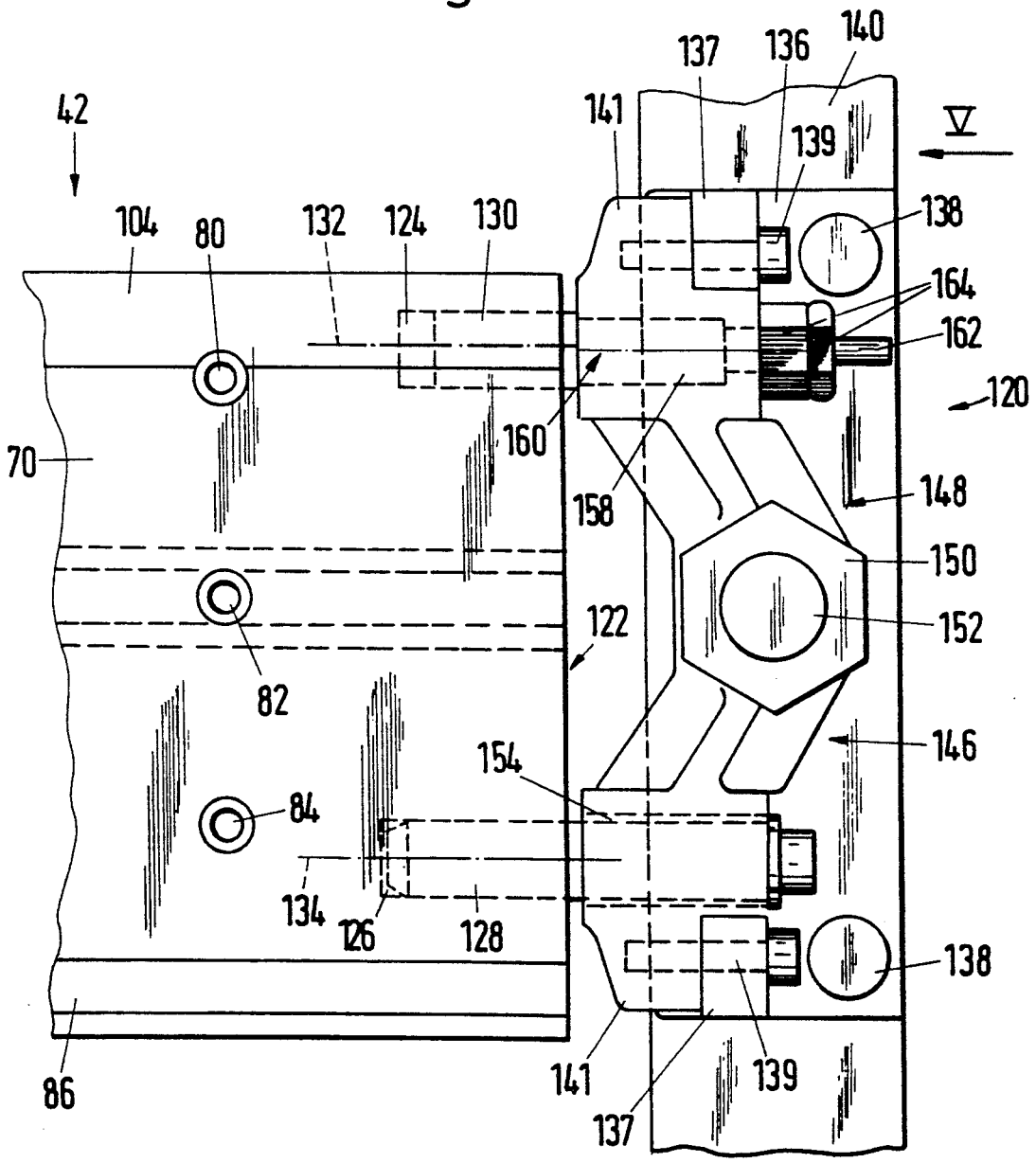
FIG. 4 is a schematic top view of an end part of a segment according to the invention and a suspension for this invention.
Figure 5:
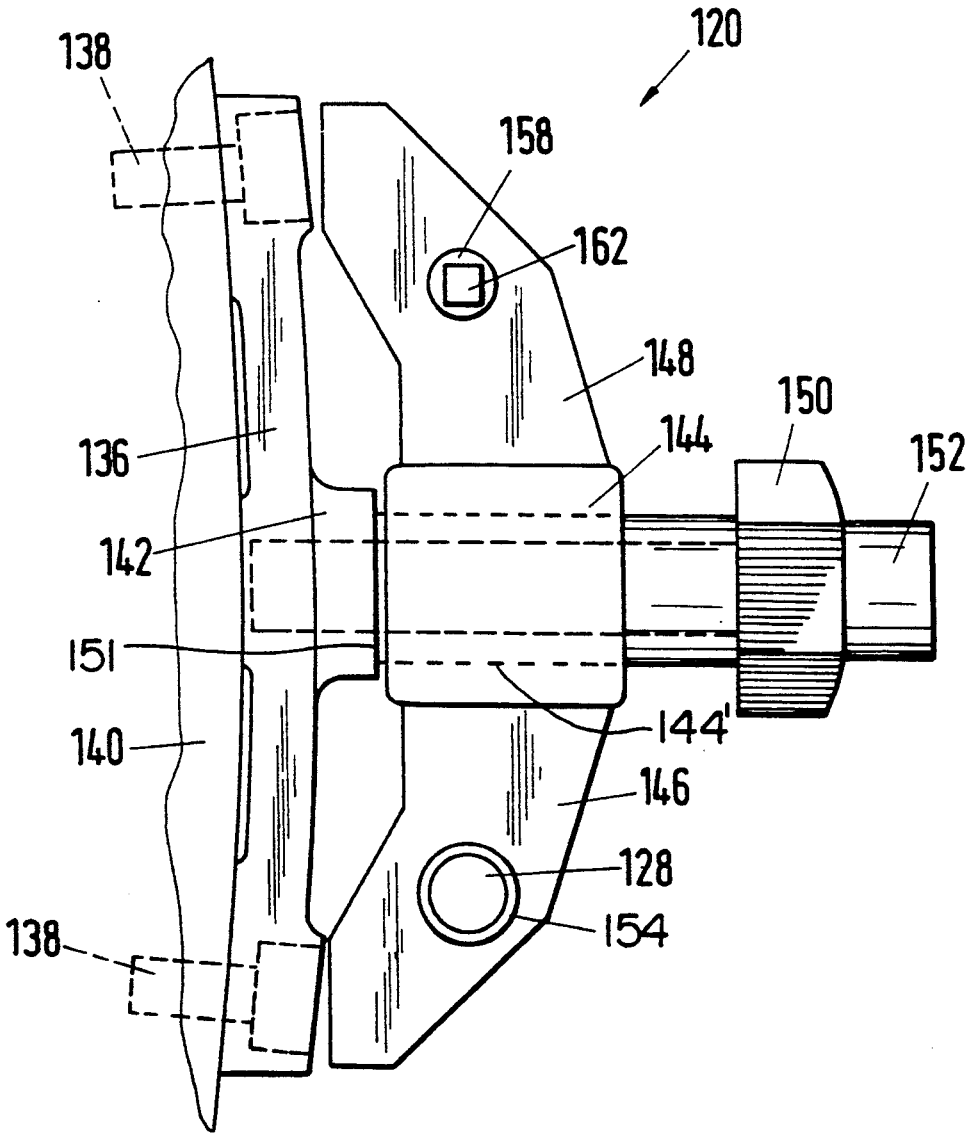
FIG. 5 is a schematic side view of a fastening plate and an adjustment device of the suspension according to FIG. 4.

FIG. 4 shows an end part of segment 42, as viewed from the direction indicated by arrow IV of FIG. 3, together with the appropriate suspension generally indicated by reference numeral 120. FIG. 5 shows the suspension alone, as viewed from the direction indicated by arrow V of FIG. 4. The front face 122 of segment 42 is provided with two holes 124, 126 extending in the longitudinal direction of the segment. Pin 128 is pressed into hole 126 and is thereby fitted in segment 42. The other hole 124 serves for fitting a second pin 130, which forms a part of the suspension 120, as will be explained in greater detail below. The other end part, which is not shown, of segment 42 is also provided with two holes, each running coaxially with holes 124, 126 thereby defining two longitudinal axes 132, 134. Suspension 120, as shown in FIG. 5 comprises a fastening plate 136, Which is fastened on a bearing bracket 140 of the card by screws 138. Plate 136 has a hub 142 with a hole extending in the radial direction of main cylinders and provided with a screw thread.

Suspension 120 includes an adjustment device with a hub part 144 and two wings 146, 148. The hub part 144 is provided with a through hole with a screw thread 144' and with an appropriate hollow adjusting screw 150. The annular front face 151 of adjusting screw 150 butts against hub 142 of fastening plate 136. Fixing screw 152 extends through a through hole of adjusting screw 150 in order to work in conjunction with the screw thread of the hub 142. When fixing screw 152 is released, it is possible to alter the adjustment of hub part 144 against fastening plate 136 by turning adjusting screw 150. The new adjustment can then be locked with fixing screw 152.

Wing 146 includes a slide bearing 154 in which is fitted pin 128. Wing 148 also has a plain bearing in which is fitted pin 158, which is formed as a single piece with pin 130, previously mentioned, but which has a longitudinal axis 160 which is offset from axis 132 as shown in FIG. 4, so that the pins 130, 158 together form an eccentric adjusting device. Pin 158 is provided with an extension 162 for association with an adjusting tool and with lock nuts 164. With an adjustment of adjusting screw 150, both pins 128, 130 are moved in approximately radial directions against main cylinder 30. This adjustment can be carried out in such a manner, for instance with a suitable gauge, such that the clothing of the neighboring element 78A to pin 128 stands at a desired clearance from the clothing of the main cylinder. In all probability, the clothing on the other two elements 78B and 78C are not at the desired clearance in relation to the clothing of the main cylinder.

Pin 128 can nevertheless be fixed in this setting by actuating fixing screw 152. The desired adjustment of the other clothing rods is then achieved by turning the eccentric device 130, 158, whereby the axis 132 turns on the axis 160 and thereby swivels segment 42 on the axis 134. Because axis 134 lies vertically over the center of element 78A, no substantial influence of the adjustment of element 78A results through the actuation of the eccentric. The total adjustment can be fixed with the locking screws 139, which extend through shoulders 137 of plate 136 in end parts 141 of both wings 146, 148. Shoulders 137 have slot-formed through holes, in order to receive the screws.

FIG. 3 also shows a setting device for blade 106, which is fastened on suspension 120 for segment 42. Every adjusting screw 150 of this suspension carries a holding element 166, which respectively carries an adjustable screw 168. Screw 168 works together with a tapped hole (not shown) in the end of blade 106. The free end of blade 106 can be adjusted against the clothing elements after loosening fixing screws 110, and adjusting screw 168 in holding element 166. Hole 108 in blade 106 is formed as a slot to accommodate this adjustment.

The present disclosure relates to subject matter contained in Swiss Patent Application No. 04 349/89-9 (filed Apr. 12, 1989), which is herein incorporated by reference in its entirety.

Although the invention has been described with reference to particular means, materials and embodiments, it is to be understood that the invention is not limited to the particulars disclosed and extends to all equivalents within the scope of the claims.

What is claimed is:

1. A main cylinder casing segment for use with a revolving flat on a card, said segment comprising:

opposite end portions, for fastening on a frame of said card, and a longitudinal body between said end portions for covering the main cylinder;

said body comprising two plate-shaped parts, a first of said two plate-shaped parts having a surface being inwardly directed toward a working area of said card during operation of said card, a second of said two plate-shaped parts comprising a stiffener for segment; and at least one longitudinally extending intermediate wall for connecting said first plate-shaped part with said second plate-shaped part and for transferring bending stresses between said parts.

2. The segment according to claim 1, formed as a hollow body between said first and second plate-shaped parts.

3. The segment according to claim 2, said hollow body comprising a plurality of longitudinal conduits extending between said end portions.

4. The segment according to claim 3, further comprising at least one longitudinal side provided with a sealing element.

5. The segment according to claim 3, further comprising means for receiving a plurality of fiber processing elements.

6. The segment according to claim 5, said means for receiving a plurality of fiber processing elements receiving three fiber processing elements, said plurality of longitudinal conduits consisting of two longitudinal conduits, said segment further comprising means for fastening at least one of said fiber processing elements on said first plate-shaped part on a side wall of one of said two longitudinal conduits.

7. The segment according to claim 5, further comprising means, associated with said end portions, for adjusting the position of said plurality of fiber processing elements with respect to said main cylinder.

8. The segment according to claim 7, said adjusting means comprising means for radially displacing one of said end portions and for swivelling said segment on a predetermined adjustment axis located at another of said end portions.

9. The segment according to claim 8, said end portions including means for determining said adjustment axis.

10. The segment according to claim 9, further comprising means for suspending said segment with respect to said main cylinder, said adjusting means being part of said suspending means.

11. The segment according to claim 10, said means for suspending comprises means for manually effecting said swivelling.

12. The segment according to claim 1, formed as an extruded profile.

13. The segment according to claim 1, formed of a light weight metal.

14. A main cylinder casing and a plurality of casing segments mounted around a working area of said main cylinder, each said casing segment comprising a casing segment according to claim 1, each said casing segment further being interchangeable with others of said casing segments around said working area of said main cylinder.

15. The main cylinder casing and casing segments according to claim 14, at least one of said casing segments being a fiber guiding segment and at least one of said casing segments being a fiber processing segment.

16. A main cylinder casing segment for use with a revolving flat on a card, said segment comprising:

a unitary body having opposite ends and including two surfaces connected by side walls at each of said opposite ends, one of said surfaces inwardly directable toward a working surface of said main cylinder, and said other surface forming part of a stiffener for said segment;

at least one conduit formed through said body; and wherein said body includes at least one intermediate wall forming at least two of said conduits.

17. A main cylinder casing segment according to claim 16, wherein said working surface is a fiber guiding surface.

18. A main cylinder casing segment according to claim 17, wherein said inwardly directed surface extends over a predetermined angular range of said main cylinder casing.

19. A main cylinder casing segment according to claim 16, wherein said unitary body is an extruded light weight metal profile.

20. A main cylinder casing segment according to claim 16, wherein said segment includes means for receiving a plurality of fiber processing elements.

21. A main cylinder casing segment according to claim 16, wherein said unitary body includes extensions at said ends, said extensions having sealing elements thereon.

22. A main cylinder casing segment according to claim 16, wherein one of said ends includes means for retaining a waste separation blade.

23. A main cylinder casing segment according to claim 22, wherein said waste separation blade is further provided with a means for adjusting said blade.

24. A main cylinder casing segment according to claim 16, wherein said segment includes on at least one of said ends, a suspension device including means for adjusting said segment in relation to said main cylinder casing.

25. A main cylinder casing segment according to claim 24, wherein said suspension device comprises two wing portions, said suspension device further comprises a bearing bracket for retaining a fastening plate, said wing portions including bearings for receiving pins extending from said ends of said segment.

26. A main cylinder casing segment according to claim 25, wherein said fastening plate includes a central hub provided with a threaded through hole.

27. A main cylinder casing segment according to claim 25, wherein said means for adjusting said segment comprises a hollow adjusting screw for passing through a hub centrally located in said wing portions, said hollow adjusting screw receiving a fixing screw.

28. A main cylinder casing segment according to claim 25, wherein at least one of said bearings and said pins form an eccentric locking device.

* * * * *